United States Patent [19]

Croxford

[11] Patent Number: 4,750,301

[45] Date of Patent: Jun. 14, 1988

[54] FLASHING FOR BUILDING CONSTRUCTION

[75] Inventor: Dean E. Croxford, New Gloucester, Me.

[73] Assignee: Manville Corporation, Denver, Colo.

[21] Appl. No.: 900,936

[22] Filed: Oct. 17, 1986

Related U.S. Application Data

[63] Continuation-in-part of Ser. No. 795,680, Nov. 6, 1985, abandoned.

[51] Int. Cl.[4] ..... E04D 1/36; E04D 3/38

[52] U.S. Cl. ..... 52/58; 29/469.5; 29/432; 52/403; 52/417; 52/469; 52/573; 403/220; 403/223

[58] Field of Search ..... 52/396, 317, 58, 167, 52/403, 417, 573, 465, 469; 182/178; 29/469.5, 432; 403/50, 51, 220, 223, 404

[56] References Cited

U.S. PATENT DOCUMENTS

| | | | |
|---|---|---|---|
| 1,915,221 | 6/1933 | Fitzgerald | 29/432 X |
| 3,300,913 | 1/1967 | Patry et al. | 52/94 X |
| 3,319,330 | 5/1967 | Patry et al. | 52/396 X |
| 4,253,227 | 3/1981 | Bullington | 29/469.5 |
| 4,663,894 | 5/1987 | La Roche et al. | 52/396 X |

FOREIGN PATENT DOCUMENTS

| | | | |
|---|---|---|---|
| 761360 | 1/1934 | France | 52/674 |
| 558875 | 1/1944 | United Kingdom | 52/DIG. 6 |

*Primary Examiner*—Alfred C. Perham

*Attorney, Agent, or Firm*—John D. Lister; Cornelius P. Quinn; Gregory A. Evearitt

[57] ABSTRACT

The use of a bifurcated joint to attach a conveniently sized metal flange to a flexible bellows material has been widely used, for example, in the manufacture of a building construction expansion joint cover. The known bifurcated joint is formed by clamping and engaging a marginal edge of the bellows material between opposed folded portions of the metal flashing. It has been found that the attaching force provided by this joint can be enhanced by providing teeth or protrusions in a portion of the metal bifurcated joint. Preferably a punch is used to upset teeth from one surface of the joint, preferably a corrugated portion of the joint, and then bend the thus toothed and corrugated portion into clamping engagement with the marginal edge of the bellows. The toothed hole clampingly engages the bellows material without piercing it and prevents pull out, both prior to curing of the adhesive bond as well as thereafter.

6 Claims, 2 Drawing Sheets

Fig. 3.
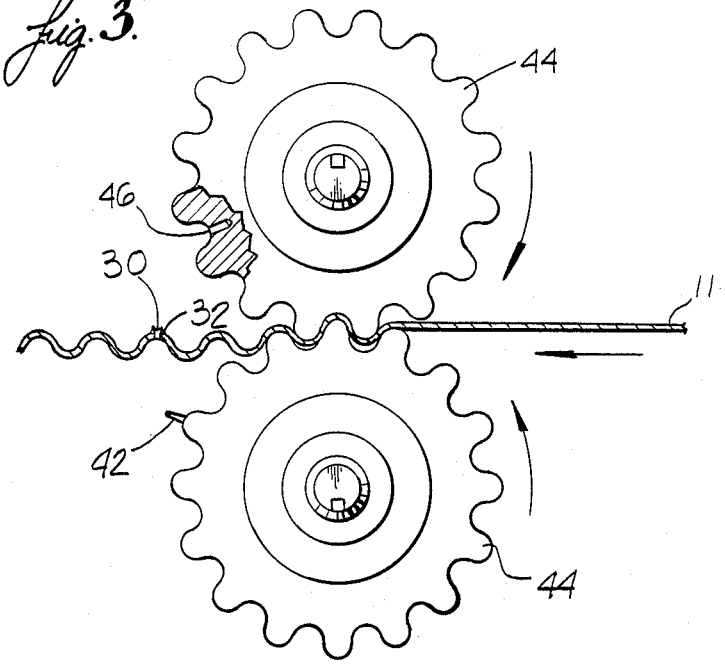
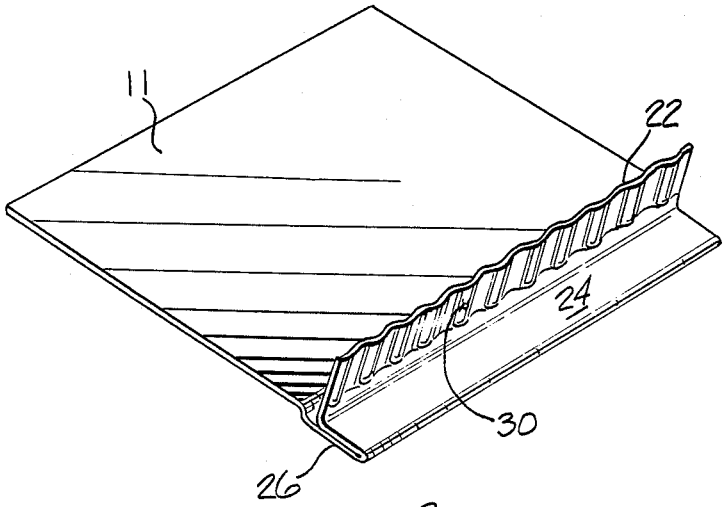
Fig. 4.

FLASHING FOR BUILDING CONSTRUCTION

This is a continuation-in-part of U.S. application Ser. No. 795,680, filed Nov. 6, 1985 now abandoned.

BACKGROUND OF THE PRIOR ART

Bellows or other flashing materials having one or more conveniently formed metal flanges attached thereto are widely used in the building construction industry. Specifically, Expand-O-Flash® expansion joint cover systems available from Manville Products Corporation utilize a bifurcated joint to permanently affix the metal flanges to the flexible bellows material. In use, each metal flange is fastened and adhered to portions of a roof construction leaving the bellows portion free to flex and thus compensate for any expansion and contraction of the building structure. This bellows construction can be made in accordance with U.S. Pats. No. 3,346,941, Re. No. 25733, and U.S. Pat. No. 3,468,285. Recently, however, it has been found that the use of more sophisticated bellows materials, specifically silicone rubber saturated glass fabric, has resulted in certain manufacturing difficulties. The adhesive material normally used to enhance the bifurcated joint tends to act as a lubricant prior to curing and sometimes causes the silicone bellows to slip out of the joint as the joint is being folded during the fabrication process. Slower production rates and a rise in rejects often result. One solution suggested by the prior art is to apply a contact adhesive to the adjoining metal and rubbery parts, permit the contact adhesive to partially or substantially cure and then bring the parts into clamping engagement. However, this solution further slows production rates.

SUMMARY OF THE INVENTION

The present invention addresses the foregoing difficulties by providing a bifurcated joint which attaches the metal flange to the flexible bellows and does so in a manner which substantially prevents the flexible bellows from slipping out of the joint during the joint fabrication process. This bifurcated joint comprises a clamping edge portion and opposed portion. A marginal edge of the bellows is positioned between the clamping edge and the opposed portion and an adhesive coating is applied to at least one surface of the marginal edge of the bellows. A hole is punched in preferably the clamping edge of the metal flashing. This hole has protruding edges which frictionly engage the surface of the bellows' marginal edge without piercing or penetrating through the full thickness of the bellows. The resulting bifurcated joint not only effectively prevents the bellows material from slipping out of the joint as it is being fabricated but also results in improved ultimate bond strength after the adhesive has fully cured.

A method for permanently joining a metal flashing to a textile or rubbery bellows material is also provided. This method involves providing an elongated metal flashing and then corrugating an edge portion of the flashing with a series of ridges and troughs perpendicular to the running length of that margini edge. Thereafter, a hole is punched in the marginal edge to create protruding teeth. The thus corrugated and toothed edge portion is bent towards another portion of said flashing to clampingly engage a marginal edge of the bellows therebetween. A step of providing adhesive material to the bellow's marginal edge before the clamping step and prior to curing of the adhesive material is also preferably employed.

BRIEF DESCRIPTION OF THE DRAWINGS

FIG. 3 shows an apparatus used in the method of forming the joint in accordance with the present invention.

FIG. 4 shows a portion of the metal flashing in an intermediate stage of completion.

DETAILED DESCRIPTION OF THE INVENTION

Figure 1:
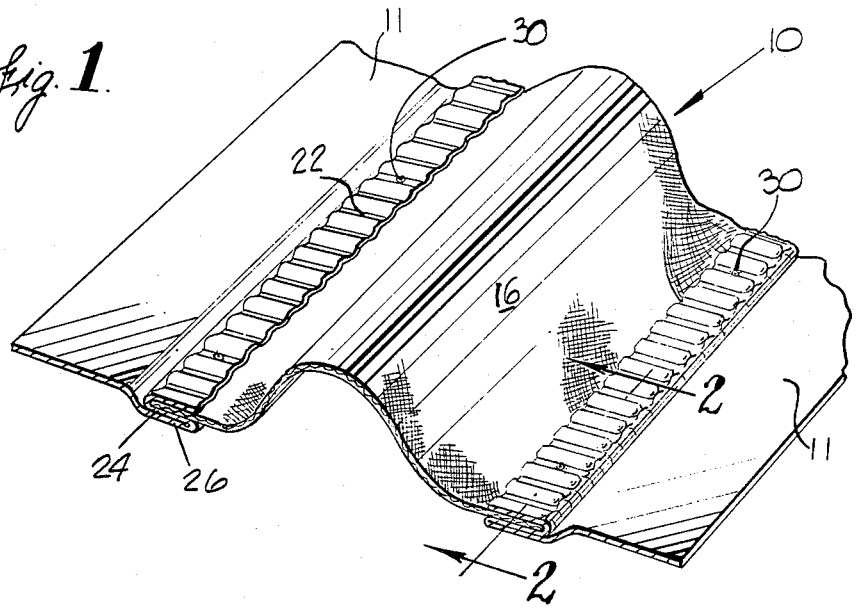
FIG. 1 shows a portion of a typical expansion joint cover in accordance with the instant invention.

FIG. 1 illustrates the basic features of a flashing, specifically an expansion joint cover 10 constructed in accordance with the present invention. Expansion joint cover 10 includes a bellows material 16 with a metal flange 11 along each running edge of the bellows 16. The joint between the bellows 16 and flange 11 comprises a bifurcation formed by a clamping edge 22 and an opposed portion comprising a first folded portion 24 and second folded portion 26 doubling back of the first folded portion. These portions of the metal flange 11 form a sandwich to clampingly engage both sides of a marginal edge of the bellows 16.

Figure 2:
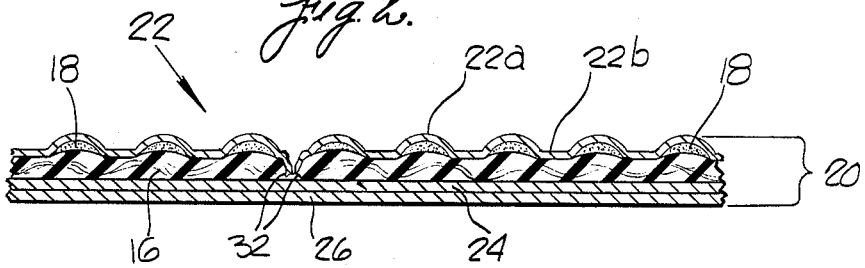
FIG. 2 shows a view of section 2—2 of FIG. 1.

A detailed sectional view taken along line 2—2 of FIG. 1 is shown in FIG. 2. Specifically, clamping edge 22 is shown having a series of corrugations comprising ridges **22*a* alternating with troughs 22*b*. Bellows material 16 is shown clamped between at least the lower surface of the troughs 22*b* and the opposed face of first folded portion 24. An adhesive shown at 18** is used to enhance the strength of the seal formed between the bellows and the metal flange.

It can also be seen from FIGS. 1 and 2 that some of the troughs **22*b* in the corrugations are provided with holes 30. Each hole 30 is preferably produced by a punching operation which provides the respective hole with upstanding or protruding teeth 32. As illustrated, teeth 32 grippingly engage the bellows' marginal edge but they do not completely pierce the bellows. However, the teeth may penetrate slightly into the bellows' material. That is, the surface of the bellows' marginal edge facing the teeth may be penetrated slightly by teeth 32**. However, under no circumstances should the teeth actually pierce through the full thickness of the bellows. Such full piercing could create a weak point in the bellows from which stress cracks could proprogate, thereby ultimately destroying the bellows material. Full piercing might also provide an avenue through which moisture might migrate.

It can also be gathered from FIGS. 1 and 2 that it is generally unnecessary, as illustrated, to provide every trough **22*b* with a punched hole. It is quite easy to select an interval of troughs between the punched holes 30 which provides adequate, non-slipping, high friction engagement between the bifurcated joint and the bellows and thus accomplish the intent of the present invention. Such an interval can be selected by simply conducting slippage tests on a few prototypes having holes 30** punched at different intervals.

FIG. 3 shows a detail of the apparatus used in forming the corrugated clamping edge 22, preferably simultaneously with the punching of the spaced, toothed holes 30. Other aspects of the process of forming the bifurcated joint and assembling the expansion joint cover or other flashing are substantially identical to those disclosed in U.S. Pat. Nos. 3,468,285, 3,300,913, 3,346,941 and Re. No. 25733 which patents are herein incorporated by reference. As illustrated in FIG. 3, a pair of opposed and counter rotating gears with interengaging teeth 44 crimp the strip of sheet metal flashing 11 and move it along its major dimension during an intermediate stage of the manufacture of the finished flashing configuration. A selected tooth is provided with a hardened steel punch 42. A corresponding valley in the opposed engaging wheel is provided with a cavity 46 to receive the punch 42. Cavity 46 is sized to not only receive the punch 42 but also to receive the resulting upstanding teeth 32 surrounding the just formed hole 30. Preferably, the corrugations are formed in the clamping edge 22 after the folding of the first folded portion 24 and second folded portion 26.

FIG. 4 shows metal flashing 11 in this stage of production just prior to insertion of the marginal edge of the bellows. The steps remaining to complete the joint preferably include applying adhesive to a marginal edge of the bellows portion, positioning the adhesive coated marginal edge between folded portion 24 and clamping edge 22 and folding clamping edge 22 towards and into engagement with the marginal edge of the bellows.

The joint, according to the instant invention, is remarkably effective in that the bellows material (even slippery bellows material containing high temperature silicone rubbers) is substantially prevented from slipping or extruding out from between the surfaces of corrugated clamping edge 22 and folded portion 24 as edge 22 is being folded over to engage the bellows and provide the joint. This is particularly impressive considering the fact that the uncured adhesive having been just applied to the bellows' marginal edge tends to act as a lubricant facilitating the bellows slippage from the joint as edge 22 is folded over.

We claim:

1. A method of permanently joining a metal flange to a marginal edge of a textile or rubbery bellows in the manufacture of a building construction expansion joint cover and the like comprising the steps of:

(a) providing an elongated metal strip;

(b) corrugating a marginal edge portion of said metal strip by forming a series of ridges and troughs perpendicular to the running length of said marginal edge;

(c) punching a hole through said marginal edge portion to create protruding, relatively sharp teeth in at least one of said troughs, the teeth extending in a direction opposite the direction of the ridges;

(d) applying adhesive to at least one of the marginal edge of the bellows and the marginal edge portion of the metal strip; and (e) folding the thus corrugated and toothed marginal edge portion towards an opposed portion of said metal flange to clamp and engage the marginal edges of said bellows therebetween so that the teeth extend into but not through the thickness of the bellows, whereby at least said troughs and said teeth fixedly engage the marginal edge of said bellows while the adhesive is curing.

2. A method as set forth in claim 1 wherein said steps of corrugating and punching occur simultaneously.

3. A method as set forth in claim 2 further including the step of providing a pair of opposed corrugated toothed rollers, and providing at least a selected one of the teeth of said toothed rollers with a penetrating punch means.

4. A method as set forth in claim 1, wherein the adhesive extends between the bellows and the corrugated marginal edge portion of the metal strip.

5. An expansion joint cover for a building construction, comprising:

a bellows having an edge portion;

a metal flange having a bifurcated edge portion comprising a corrugated clamping portion and an opposed portion;

the corrugated clamping portion comprising a plurality of ridges and troughs;

the edge portion of the bellows being clamped between the corrugated clamping portion and the opposed portion of the metal flange so that the surface of the corrugated clamping portion corresponding to the troughs engages the edge portion of the bellows;

at least one of the troughs containing teeth extending toward the opposed portion of the bifurcated edge portion and into but not through the thickness of the bellows; and adhesive material adhering the edge portion of the bellows to the bifurcated edge portion of the metal flange.

6. An expansion joint cover according to claim 5, wherein the trough containing the teeth contains a punched hole, the teeth extending from the edge of the hole as a result of the hole punching operation.

* * * * *